US011394178B2

(12) United States Patent
Traub et al.

(10) Patent No.: US 11,394,178 B2
(45) Date of Patent: Jul. 19, 2022

(54) SPARK PLUG INCLUDING ROUNDED INSULATOR BASE SECTION

(71) Applicant: Robert Bosch GmbH, Stuttgart (DE)

(72) Inventors: Felix Traub, Sindelfingen (DE); Matthias Blankmeister, Heiligenhaus (DE); Sergej Subkow, Kornwestheim (DE); Stephan Kaske, Sternenfels Diefenbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/309,674

(22) PCT Filed: Dec. 10, 2019

(86) PCT No.: PCT/EP2019/084395
§ 371 (c)(1),
(2) Date: Jun. 14, 2021

(87) PCT Pub. No.: WO2020/126663
PCT Pub. Date: Jun. 25, 2020

(65) Prior Publication Data

US 2022/0085578 A1 Mar. 17, 2022

(30) Foreign Application Priority Data

Dec. 20, 2018 (DE) ..... 102018222460.9

(51) Int. Cl.
*H01T 13/36* (2006.01)
*H01T 13/32* (2006.01)
*H01T 13/54* (2006.01)

(52) U.S. Cl.
CPC ..... *H01T 13/36* (2013.01); *H01T 13/32* (2013.01); *H01T 13/54* (2013.01)

(58) Field of Classification Search
CPC ..... H01T 13/36; H01T 13/32; H01T 13/54; H01T 13/20
See application file for complete search history.

(56) References Cited

U.S. PATENT DOCUMENTS 4,193,012 A 3/1980 Podiak et al.
2012/0240890 A1 9/2012 Johng
(Continued)

FOREIGN PATENT DOCUMENTS

DE 2938986 A1 4/1980
DE 69924786 T2 3/2006
(Continued)

OTHER PUBLICATIONS

International Search Report for PCT/EP2019/084395, dated Mar. 6, 2020.

*Primary Examiner* — Kevin Quarterman
(74) *Attorney, Agent, or Firm* — Norton Rose Fulbright US LLP; Gerard Messina

(57) ABSTRACT

A spark plug including a housing, an insulator, a center electrode, and a ground electrode situated at a combustion chamber-side end of the housing. The insulator has an insulator collar, an insulator base, and a transition area, which rests on a projection of the housing. A breathing space is configured at the combustion chamber-side end of the spark plug and is delimited by a section of the inner side of the housing and a section of the insulator base. The section of the insulator base has a rounding including a first leg length and a second leg length angled with respect to the first leg length, the first leg length extending between the intersecting point of the leg lengths with one another and a first end point of the rounding, and the second leg length extending between the intersecting point and a second end point of the rounding.

12 Claims, 5 Drawing Sheets

(56) References Cited

U.S. PATENT DOCUMENTS

| | | | | |
|---|---|---|---|---|
| 2013/0147339 | A1* | 6/2013 | Burrows | H01T 13/20<br>313/143 |
| 2016/0285240 | A1* | 9/2016 | Hisada | H01T 13/20 |

FOREIGN PATENT DOCUMENTS

| | | | |
|---|---|---|---|
| DE | 102012012210 | A1 | 12/2013 |
| DE | 102013203566 | A1 | 9/2014 |
| DE | 102014210922 | A1 | 12/2015 |
| DE | 102015207886 | A1 | 11/2016 |
| DE | 102017107679 | A1 | 10/2018 |
| DE | 102018201354 | A1 | 8/2019 |
| EP | 2789064 | A1 | 10/2014 |
| EP | 3073590 | A1 | 9/2016 |
| JP | 2000294360 | A | 10/2000 |
| WO | 2013086479 | A1 | 6/2013 |

* cited by examiner

SPARK PLUG INCLUDING ROUNDED INSULATOR BASE SECTION

FIELD

The present invention relates to a spark plug and to a prechamber spark plug.

BACKGROUND INFORMATION

In today's internal combustion engines in the automobile sector, there is a trend toward increasingly higher pressures, and thus also toward higher temperatures in the respective combustion chambers of the cylinders. Higher performances are achieved as a result of these highly supercharged internal combustion engines. Due to the higher pressures and the higher temperatures in the combustion chamber, the requirements with regard to the individual components, such as for example with regard to the spark plug, are also increasing. For example, the spark plug is not only subject to the pressure, temperature, and chemical conditions during normal operation of the internal combustion engine, but also to more extreme conditions during irregular events in the internal combustion engine. One of these irregular events is the preignition.

During the regular ignition during normal operation of the internal combustion engine, the ignition of the air/fuel mixture is initiated by the spark plug during a certain operating cycle of the internal combustion engine. The ignition results in a desired pressure and temperature increase which is used, for example, for driving the wheels in the case of a motor vehicle or a generator for power generation. The combustion chamber temperatures of a highly supercharged internal combustion engine are considerably higher than in a low-pressure supercharged internal combustion engine, resulting in a higher thermal load on the spark plug as well as the challenge of designing the spark plug in such a way that no irregular combustion events, such as self-ignition, occur at the spark plug.

During another irregular combustion event, the preignition, the air/fuel mixture ignites in any location having an excessively high temperature other than at the spark plug in the combustion chamber prior to the actual ignition timing, during an arbitrary operating cycle of the cylinder. As a result of this preignition of the air/fuel mixture, a flame front arises, which propagates in the combustion chamber. This flame front is accompanied by a pressure increase and a corresponding temperature increase. This temperature increase and the pressure increase may result in the so-called mega knocking in the engine. Within a mega knock event, the pressure in a pressure peak increases to a multiple of the maximum pressure during a regular combustion, causing the spark plug and the other components in the combustion chamber to experience loads. Due to these pressure peaks during the mega knock event, the insulator of the spark plug may break and result in a failure of the cylinder in which the damaged spark plug is installed.

There are different approaches in the related art as to how to design the spark plug itself to be more robust, so that it withstands the pressure peaks during mega knocks.

German Patent Application No. DE 10 2012 012 210 A1 describes one example for a spark plug in which the spark plug includes an annular projection at the combustion chamber-side end of the housing, by which the inlet of the breathing space is reduced and the pressure peaks from a mega knock event cannot penetrate into the breathing space of the spark plug, by which the insulator is to be protected.

European Patent No. EP 2789064 B1 describes a spark plug in which the insulator seat geometry was improved to the effect that a smaller preload is sufficient for a gas-tight installation of the insulator in the housing, and thus overall a lower tensile stress acts on the insulator during the installation, and the insulator has an improved flexural strength during mega knock events.

It is an object of the present invention to provide a spark plug in which the tendency toward undesirable preignition is minimized or eliminated, and which is additionally protected against the mega knocks resulting from the preignition events.

SUMMARY

The object may be achieved by a spark plug according to an example embodiment of the present invention. In accordance with an example embodiment of the present invention, the spark plug includes a housing, an insulator partially situated in the housing, a center electrode, and a ground electrode. The housing has a longitudinal axis which extends from the combustion chamber-side end to the end of the housing facing away from the combustion chamber, the housing including a borehole along its longitudinal axis, as a result of which the housing has an inner side. The housing includes a projection on its inner side. The insulator partially situated in the housing borehole has a longitudinal axis which extends from the combustion chamber-side end to the end of the insulator facing away from the combustion chamber. The insulator has an insulator collar, which is radially surrounded by the housing, an insulator base, which is the combustion chamber-side end of the insulator and has a smaller diameter than the insulator collar, and a transition area, which connects the insulator collar and the insulator base to one another and rests on the projection of the housing. The center electrode is situated in the insulator. The ground electrode is situated at a combustion chamber-side end of the housing, the ground electrode and the center electrode being situated in such a way that, together, they form an ignition gap. The spark plug furthermore includes a breathing space, which is configured at the combustion chamber-side end of the spark plug, the breathing space being delimited by a section of the housing and a section of the insulator base and having an opening to the combustion chamber.

According to an example embodiment of the present invention, it is provided that the section of the insulator base delimiting the breathing space includes a rounding, the rounding, as viewed in the cross-section, having a first leg length and a second leg length angled with respect to the first leg length, the first leg length being greater than the second leg length, the first leg length extending between the intersecting point of the leg lengths with one another and a first end point of the rounding, and the second leg length extending between the intersecting point of the leg lengths with one another and a second end point of the rounding. The contour of the insulator base resulting from the rounding yields the advantage that the breathing space between the housing and the insulator base is flushed well during normal operating conditions, so that a good heat distribution and heat dissipation arise in the insulator base. This prevents undesirable preignitions at the spark plug.

Examinations of the applicant on spark plugs according to the present invention have shown a second effect. When a preignition and the associated critical pressure and temperature conditions, at approximately 110 bar and approximately 850 K, are present, the gas mixture in the breathing space heats so drastically that a further (second) ignition occurs in the area of the insulator base. The spark plug is thereafter surrounded by a burned air/fuel mixture, and the breathing space of the spark plug is filled with it. This burned fuel/air mixture acts like a protective cushion for the spark plug against the pressure peaks of the mega knock event. The pressure peaks are subject to a greater dispersion and attenuation in the burned air/fuel mixture than in the unburned air/fuel mixture, which is why the pressure peaks are attenuated more strongly in the protective cushion of the spark plug, and the pressure peaks reach the spark plug in a considerably weakened form, or are even completely attenuated. In this way, the spark plug, in particular, the insulator, experiences less drastic loading from the pressure peaks of the mega knock event. The pressure and temperature conditions starting at which the second effect becomes dominant specifically depend on the combination of the spark plug and the engine.

Advantageous refinements of the present invention are described herein.

In one advantageous refinement of the present invention, it is provided that the first leg length is at least 1.5 times, preferably at least 2 times, particularly preferably 5 times the second leg length. In this way, it is ensured that the rounding at the section of the insulator base is large enough for the above-described technical effects to arise.

In one refinement of the present invention, it is additionally or alternatively provided that the first leg length is no more than 10 times, preferably 7 times, the second leg length.

Advantageously, the first leg length extends in parallel to the longitudinal axis of the insulator, and the second leg length extends perpendicularly to the longitudinal axis of the insulator. This results, in particular also in combination with the upper limit for the maximum first leg length, in the breathing space having a sufficiently large width (distance between insulator base and housing inner side perpendicular to the longitudinal axis at the opening of the breathing space toward the combustion chamber) in relation to its length (measured in parallel to the longitudinal axis) so that, on the one hand, the breathing space may be flushed sufficiently well during normal operating conditions, so that the insulator base does not become too hot, and, on the other hand, also the second ignition protecting the spark plug may take place.

Advantageously, in accordance with an example embodiment of the present invention, the rounding may be described by the two leg lengths L1 and L2 as well as the two angles $\alpha_1$ and $\alpha_2$, angle $\alpha_1$ spanning between the tangent of the rounding in the second end point of the rounding and a first parallel, passing through the second end point of the rounding, to the longitudinal axis of the insulator, and angle $\alpha_2$ spanning between the tangent of the rounding in the first end point of the rounding and a second parallel, passing through the first end point of the rounding, to the longitudinal axis of the insulator, angle $\alpha_1$ having a value of greater than or equal to 0° and smaller than or equal to arctan (L2/L1) and/or angle $\alpha_2$ having a value of greater than or equal to arctan (L2/L1) and smaller than or equal to 90°, and the second end point of the rounding being closer to the combustion chamber-side end of the spark plug than the first end point of the rounding.

In particular, the rounding is a concave rounding at the insulator base. This means that the rounding is curved toward the longitudinal axis of the insulator. In this way, the flow is guided particularly well and with low turbulence in the breathing space. This effect flushes the hot gases (residual gas) effectively out of the breathing space, by which a good heat distribution and heat dissipation arise in the insulator base.

In one refinement of the spark plug according to an example embodiment of the present invention, it is provided that the rounding extends across the entire section of the insulator base which delimits the breathing space. This may, in particular, be advantageous in the case of spark plugs having a low heat rating, and thus a short insulator base, as well as in the case of prechamber spark plugs.

In one alternative embodiment of the present invention, the insulator base may also include multiple sections, it also being possible, in turn, for one section to include multiple segments. The insulator base has a section which delimits the breathing space, this section having at least one segment which includes the rounding according to the present invention. In addition to the segment including the rounding, the section of the insulator base which delimits the breathing space may also include one or multiple segment(s) having a cylindrical and/or conical shape or rounding. The segments having the different shapes steadily transition into one another. The other sections of the insulator base may have a cylindrical and/or conical shape or also a rounding. The sections having the different shapes steadily transition into one another.

As an alternative or in addition to the rounding according to an example embodiment of the present invention, a layer may be at least partially applied to the section of the insulator base which delimits the breathing space and/or to the housing inner side delimiting the breathing space, which is configured to trigger a second ignition at the spark plug during irregular combustions in the combustion chamber. The layer is a catalytic layer, for example, which undergoes an exothermic chemical reaction starting at a certain pressure and/or starting at a certain temperature, by which a second ignition of the air/fuel mixture is initiated, the protective cushion in turn forming around the spark plug.

As an alternative or in addition, a piezoelectric element may be situated at the spark plug, which releases an electrical pulse starting at a certain pressure, by which, in turn, the second ignition is initiated, and the protective cushion forms around the spark plug.

These two alternatives to the insulator base including a rounded section may also be employed in spark plugs in which, for whatever reason, the section of the insulator base which delimits the breathing space cannot include a rounding having two different leg lengths, so that the advantageous second technical effect may also be implemented in these spark plugs.

The second technical effect, the generation of a protective cushion during irregular combustions in the combustion chamber, may furthermore also be achieved by a different geometric configuration of the insulator base.

The present invention furthermore also relates to a prechamber spark plug. In accordance with an example embodiment of the present invention, the prechamber spark plug includes a housing, which has a longitudinal axis extending from the combustion chamber-side end to the end of the housing facing away from the combustion chamber. The housing includes a borehole along its longitudinal axis, as a result of which the housing has an inner side. The housing includes a projection on its inner side. An insulator is partially situated in the housing borehole, the insulator having a longitudinal axis which extends from the combustion chamber-side end to the end of the insulator which faces away from the combustion chamber, and the insulator including an insulator collar, which is radially surrounded by the housing, an insulator base, which is the combustion chamber-side end of the insulator and has a smaller diameter than the insulator collar, and a transition area, which connects the insulator collar and the insulator base to one another and rests on the projection of the housing. The spark plug furthermore also includes a center electrode situated in the insulator, a cap, which is situated at a combustion chamber-side end of the housing and forms a prechamber, a ground electrode situated at the housing or at the cap, the ground electrode and the center electrode being situated in such a way that, together, they form an ignition gap, and a breathing space, which is formed at the combustion chamber-side end of the spark plug, the breathing space being delimited by a section of the inner side of the housing and a section of the insulator base and having an opening to the combustion chamber volume enclosed by the cap. According to an example embodiment of the present invention, the section of the insulator base which delimits the breathing space includes a rounding, the rounding, as viewed in the cross-section, having a first leg length and a second leg length angled with respect to the first leg length, the first leg length being greater than the second leg length, the first leg length extending between the intersecting point of the leg lengths with one another and a first end point of the rounding, and a second leg length extending between the intersecting point of the leg lengths with one another and a second end point of the rounding.

This may yield an advantage that the breathing space between the housing and the insulator base is flushed well during normal operating conditions, so that a good heat distribution and heat dissipation arise in the insulator base, achieving that undesirable preignitions do not occur at the spark plug.

The prechamber spark plug according to the present invention may also be refined with the features of the above-described refinements of the spark plug according to the present invention.

BRIEF DESCRIPTION OF THE DRAWINGS

Exemplary embodiments of the present invention are described in detail hereafter with reference to the figures.

DETAILED DESCRIPTION OF EXAMPLE EMBODIMENTS

Figure 1:
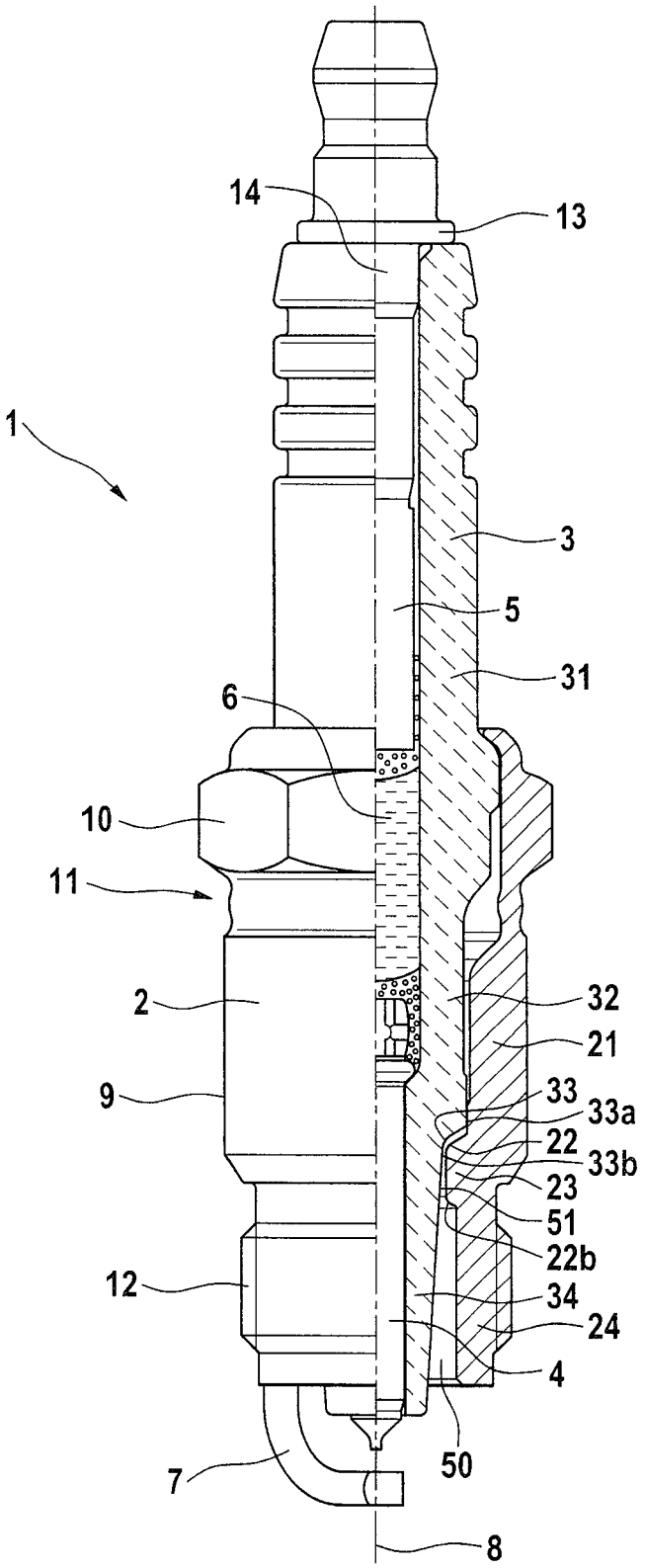
FIG. 1 shows a generally conventional spark plug.

FIG. 1 shows a generally conventional spark plug 1 in a semi-sectional view. This overview figure is used to introduce the different components and sections of the spark plug and to delimit them from one another. The exemplary embodiments for an insulator base including a rounding according to the present invention shown in FIGS. 2 through 4 may be employed in a spark plug according to FIG. 1.

Spark plug 1 includes a housing 2. An insulator 3 is inserted into housing 2. Housing 2 and insulator 3 each have a borehole and each have a longitudinal axis, which coincide with center axis 8 of the spark plug. A center electrode 4 is inserted into insulator 3. Furthermore, a connecting bolt 5 is inserted into insulator 3. A resistance element 6 is situated in insulator 3 between center electrode 4 and connecting bolt 5. Resistance element 6 connects center electrode 4 to connecting bolt 5 in an electrically conducting manner. A ground electrode 7 is connected to housing 2 in an electrically conducting manner on the side facing the combustion chamber. The corresponding ignition spark is generated between ground electrode 7 and center electrode 4. Spark plug 1 extends around center axis 8.

Housing 2 includes a shank 9. A polygon 10, a shrink stitch 11, and a thread 12 are configured at this shaft 9. Thread 12 is used to screw spark plug 1 into an internal combustion engine.

Connecting bolt 5 includes a bolt shank 14, which extends along center axis 8, and a collar 13. Connecting bolt 5 rests with collar 13 on insulator 3.

Insulator 3 includes an insulator head 31, an insulator collar 32, and an insulator base 34. Insulator head 31 is the end of insulator 3 which faces away from the combustion chamber and protrudes from housing 2 on the side of spark plug 1 which faces away from the combustion chamber. Insulator base 34 is the end of insulator 3 which faces the combustion chamber. Insulator collar 32 is situated between insulator head 31 and insulator base 34. Insulator collar 32 is radially surrounded by housing 2. There is a transition area 33 between insulator collar 32 and insulator base 34, with which insulator 3 rests on projection 22 of housing 2. Transitions 33*a*, 33*b* from insulator collar 32 to transition area 33 as well as from transition area 33 to insulator base 34 are identified in FIG. 1.

Insulator base 34 extends from base fillet 33*b*, which is the transition from transition area 33 to insulator base 34 and is typically configured as a rounding, to insulator base tip, which is the combustion chamber-side end of insulator base 34. Insulator base 34 of spark plug 1 in FIG. 1 has a conical shape and may be divided into two sections 341, 348. First section 341 of insulator base 34 directly abuts root fillet 33*b*. First section 341 of insulator base 34 is radially surrounded by a protrusion 23 situated on the inner side of housing 2. Protrusion 23 is delimited on the side facing away from the combustion chamber by projection 22, on which insulator 3 rests, and on its side facing the combustion chamber by a section 22*b* in which the housing inside diameter increases again. Protrusion 23 itself has an essentially constant inside diameter. Together with this protrusion 23, first section 341 forms a narrow gap 51, a so-called bottle neck. This narrow gap 51 has a considerably smaller width, and thus a considerably smaller volume, than breathing space 50 and, within the scope of the present application, does not belong to breathing space 50. Breathing space 50 extends from the combustion chamber-side end of gap 51 to the combustion chamber-side end face of housing 2. Breathing space 50 is furthermore delimited by a section 24 of the housing and a second section 348 of insulator base 34.

As an alternative, housing 2 may also only include projection 22 on which insulator 2 rests, and may have a constant or conically increasing inside diameter in the direction of the combustion chamber. In this case, there is no narrow gap 51, and breathing space 50 begins directly at the end of base fillet 33*b* which faces the combustion chamber.

Not shown in FIG. 1 is an inner seal, which may, for example, be situated between projection 22 of housing 2 and transition area 33 of insulator 3, and thus seals the space between housing 2 and insulator 3.

Figure 2:
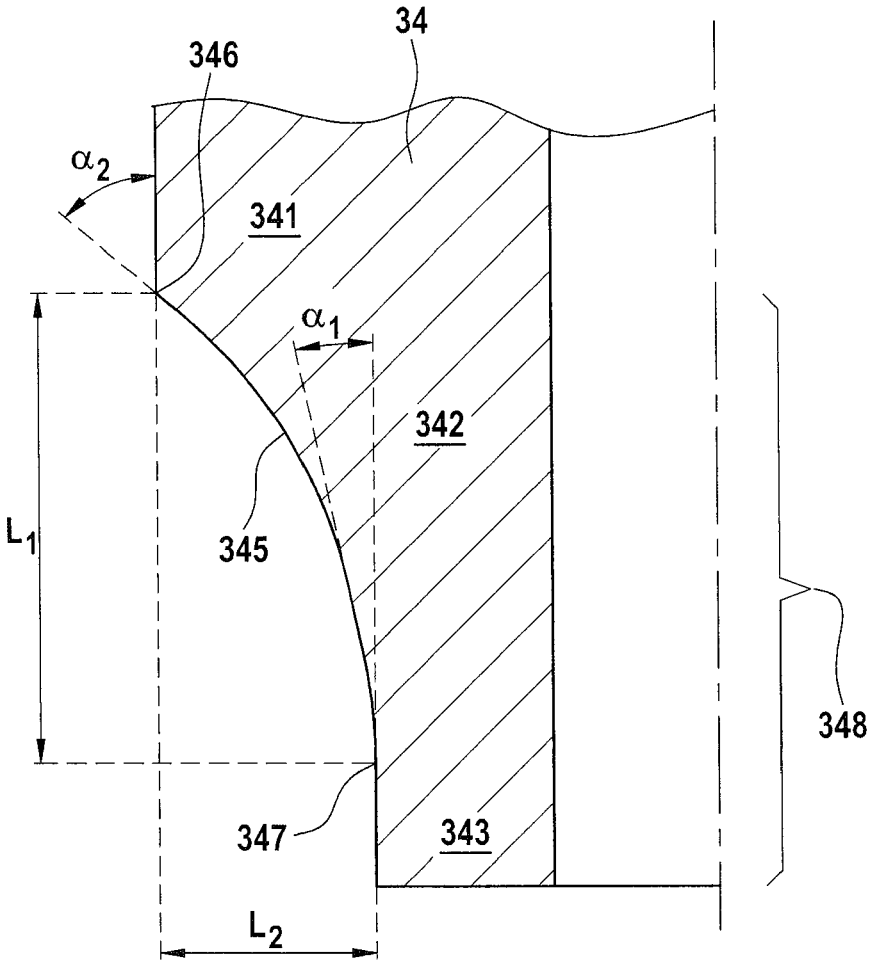
FIG. 2 shows a section of the insulator including a rounding according to an example embodiment of the present invention at the insulator base.

FIG. 2 shows a schematic representation of insulator base 34. This representation is used to illustrate the different sections of insulator base 34 as well as the representation of leg lengths L1, L2 as well as angles $\alpha_1$, $\alpha_2$. In this example, insulator base 34 may be divided into two sections 341, 348. First section 341 has a cylindrical shape and could, for example, delimit narrow gap 51 beneath base fillet 33*b*. Second section 348 has two segments 342, 343. First segment 342 includes rounding 345 according to the present invention. Second segment 343 has a conical shape and a smaller outside diameter than first section 341.

Rounding 345 has its first end point 346 at the transition point to first section 341 of insulator base 34. The transition point is shown as a corner in this figure. Rounding 345 has its second end point 347 at the transition point to second segment 343. This transition point arises from angle $\alpha_1$ to a parallel of longitudinal axis 8 of insulator 3 which extends through second end point 347 becoming minimal, and remaining or being minimal or changing the sign. In the example shown here, $\alpha_1$=0 and remains at 0 since second segment 343 has a cylindrical shape. Leg lengths L1, L2 extend in parallel or perpendicularly to longitudinal axis 8 of insulator 3. In the process, a leg length is always measured between the intersecting point of the legs with one another and first and second end point 346, 347 of rounding 345.

For example, first leg length L1 may be greater than or equal to 3 mm and smaller than or equal to 20 mm. Second leg length L2 then, for example, has a value of equal to or greater than 0.6 mm and smaller than or equal to 3 mm.

Figure 3A:
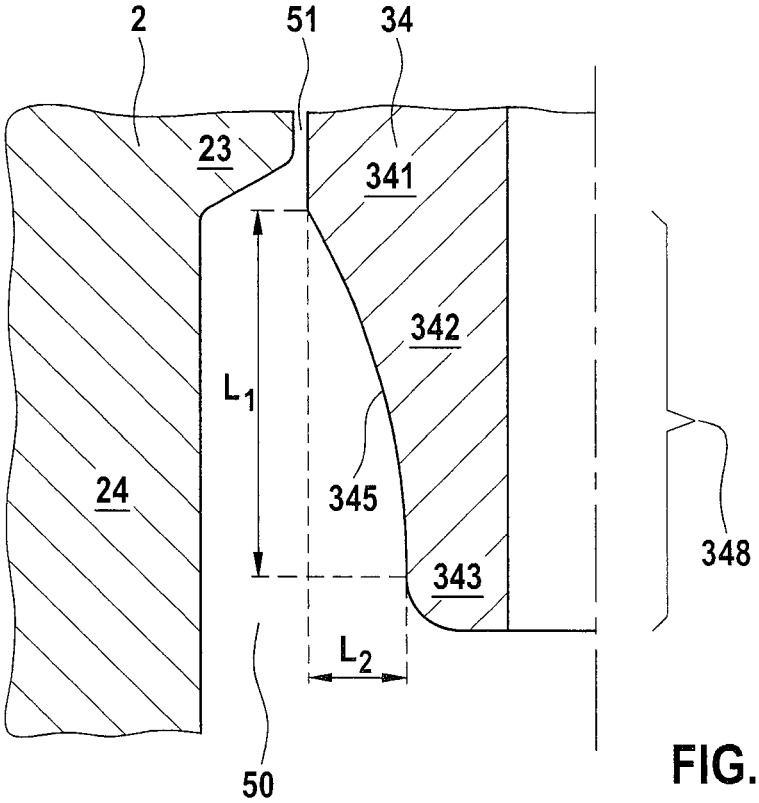
FIGS. 3*a* and 3*b* show schematic representations of the breathing space for two exemplary embodiments of the present invention.
Figure 3B:
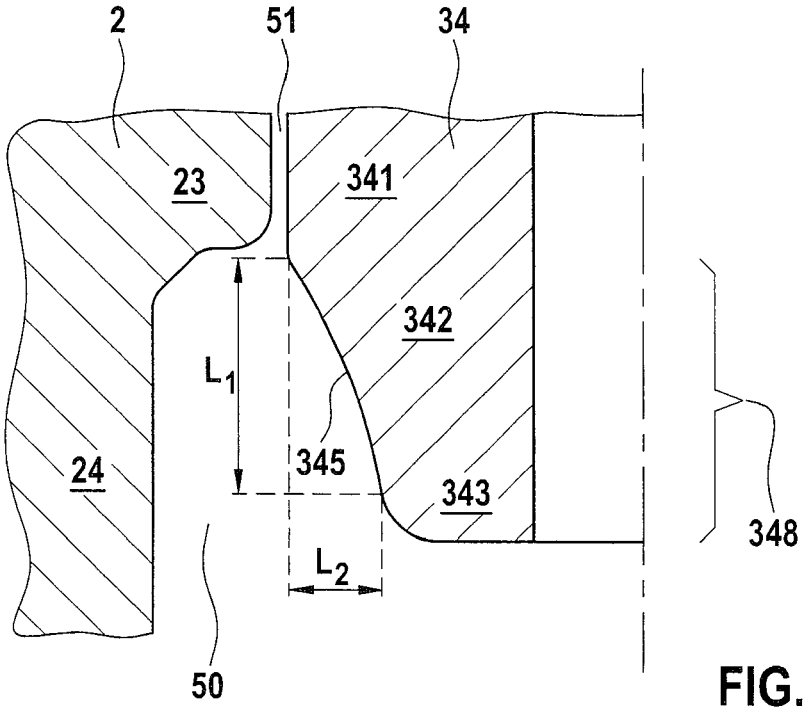

FIGS. 3*a* and 3*b* show two examples in which section 24 of housing 2 which delimits breathing space 50 and section 348 of insulator base 34 which delimits breathing space 50, and thus also the resulting breathing space 50, are shown. Indicated are projection 23 on the inner side of housing 2 as well as first section 341 of insulator base 34, which together with projection 23 forms narrow gap 51. In the direction of the combustion chamber, breathing space 50 abuts narrow gap 51, which is delimited by a second section 348 of insulator base 34 and a housing section 24. By way of example, it is apparent that in the case of housing 2 and in the case of insulator 3 edges and corners are designed to be angular, conical or with roundings.

In FIGS. 3*a* and 3*b*, the second section of insulator base 34 always has a second segment 343, which includes a convex rounding. Rounding 345 according to the present invention has a concave shape. Second end point 347 of rounding 345 according to the present invention arises at the point when angle $\alpha 1$ becomes minimal. In FIG. 3*a*, thus $\alpha 1$=0°, L1 is 4.2 mm, and L2 is 1.2 mm. A ratio of L1/L2 of 3.5 results for the exemplary embodiment according to FIG. 3*a*.

In FIG. 3*b*, al becomes minimal and is dissimilar to 0°. For example, L1=2 mm and L2=1 mm may apply, thereby resulting in a ratio of L1 to L2 of 2. In second segment 343, angle $\alpha 1$ increases again for a tangent along the surface of second segment 343. In other words, the radius of curvature of rounding 345 of first segment 342 has a different sign than the radius of curvature of the rounding of second segment 343. The point at which the radius of curvature changes its sign is second end point 347 of rounding 345 according to the present invention. Rounding 345 according to the present invention does not have to end in a straight line.

FIGS. 4*a*-4*i* show a number of different embodiments of insulator base 34, the enumeration not being exhaustive. In all example embodiments here, insulator base 34 has a first section 341, which is designed with rounding 345 according to the present invention between base fillet 33*b* and section 348 of insulator base 34. Together with a projection 23 formed at housing 2, this first section 341 may form narrow gap 51 or may, measured in parallel to the longitudinal axis, be so short that this section is essentially negligible. Furthermore, all specific embodiments show second section 348 of insulator base 34, which has a first segment 342 including rounding 345 according to the present invention and partially a second segment 343 without the rounding according to the present invention. For all exemplary embodiments, leg lengths L1 and L2 as well as the approximate positions of first and second end points 346, 347 of rounding 345 according to the present invention are plotted.

Figure 4A:
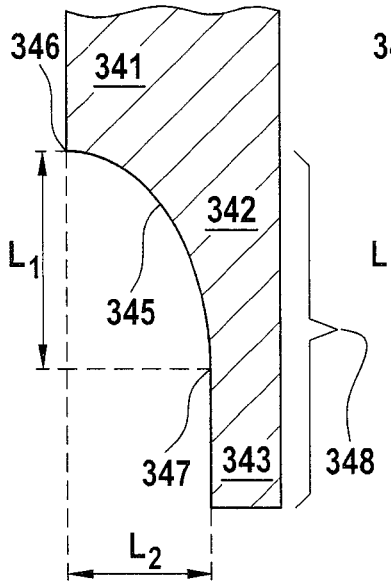
FIGS. 4*a*-4*i* show a plurality of embodiments of the rounding according to an example embodiment of the present invention at the insulator base.

In FIG. 4*a*, first section 341 has a cylindrical shape. Rounding 345 according to the present invention has $\alpha 2$=90° at its first end point 346, and $\alpha 1$=0° at its second end point 347. At second end point 347, rounding 345 transitions into a straight line, which transitions into the cylindrical shape of second segment 343.

Figure 4B:
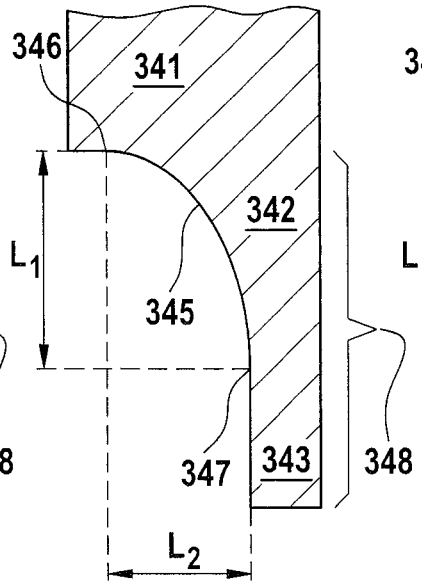

FIG. 4*b* differs from FIG. 4*a* in that first end point 346 of rounding 345 according to the present invention is radially further to the inside, and does not rest directly on the edge and transition to first section 341 of insulator base 34. In this example, rounding 345 also transitions into a straight line in its first end point 346.

Figure 4C:
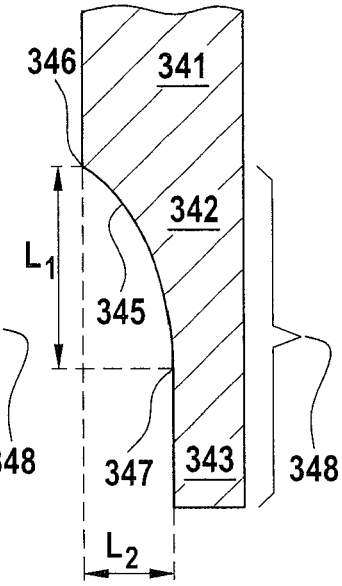

FIG. 4*c* differs from FIG. 4*a* in that, in first end point 346, the tangent has an angle $\alpha 2$ of smaller than 90° and greater than 45°.

Figure 4D:
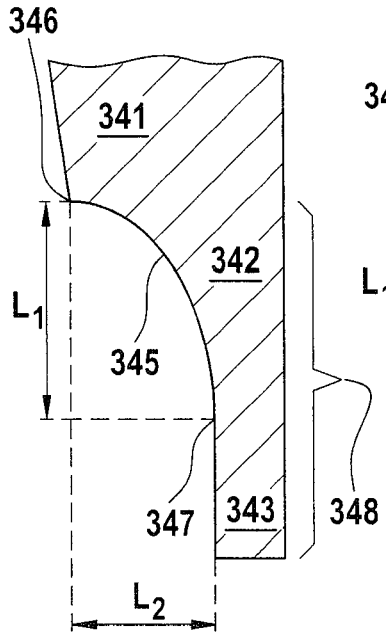

FIG. 4*d* differs from FIG. 4*a* in that first section 341 has a conical shape.

Figure 4E:
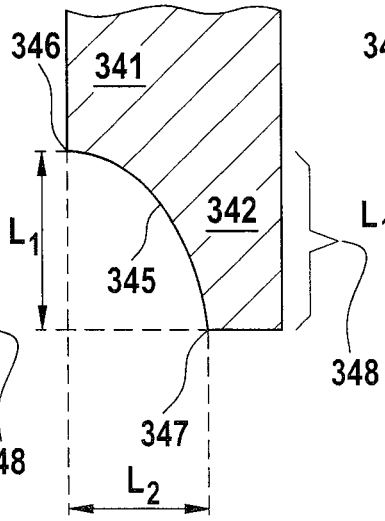

FIG. 4*e* differs from FIG. 4*a* in that second section 348 of insulator base 34 only includes first segment 342 including rounding 345 according to the present invention.

Figure 4F:
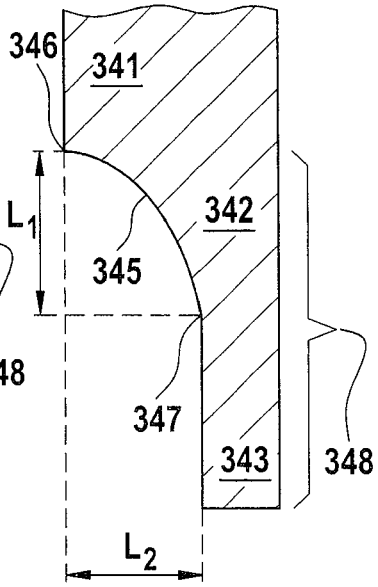

FIG. 4*f* differs from FIG. 4*a* in that, in second end point 347, angle $\alpha 1$ is greater than 0° and smaller than 45°.

Figure 4G:
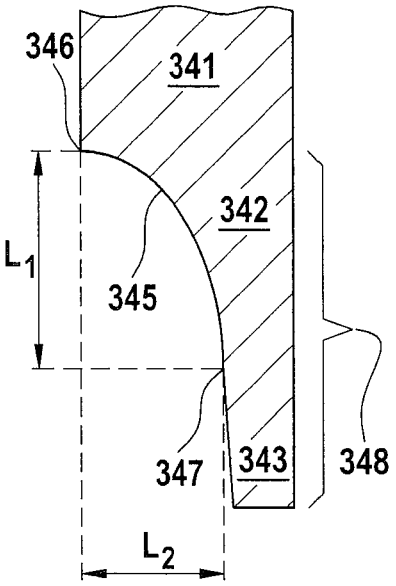

FIG. 4*g* differs from FIG. 4*a* in that second segment 343 has a conical shape.

Figure 4H:
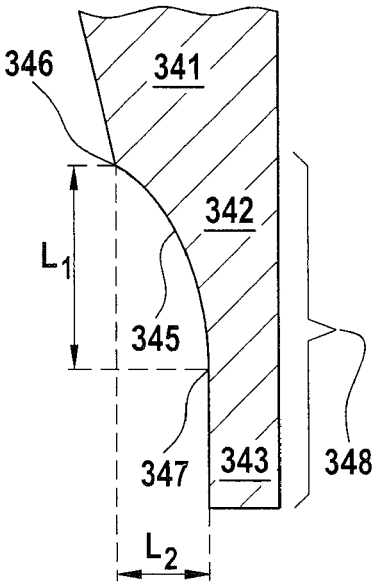

FIG. 4*h* differs from FIG. 4*d* in that, in first end point 346 of rounding 345 according to the present invention, angle $\alpha 2$ is smaller than 90° and greater than 45°.

Figure 4I:
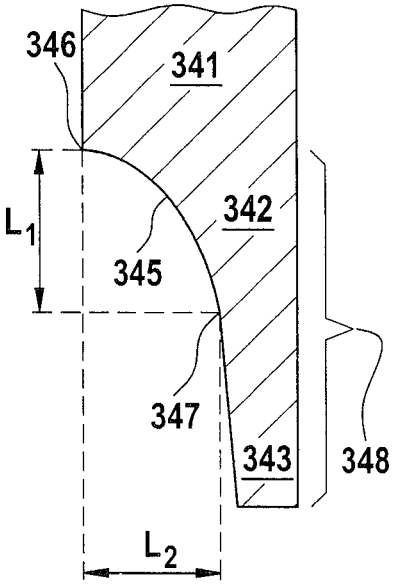

FIG. 4*i* differs from FIG. 4*f* in that second segment 343 has a conical shape.

All shown edges may also be chamfered or have small convex roundings.

The specific embodiments shown here for an insulator base including a rounding according to the present invention may also be used in a prechamber spark plug.

What is claimed is:

1. A spark plug, comprising:

a housing, the housing having a longitudinal axis which extends from a combustion chamber-side end of the housing to an end of the housing which faces away from a combustion chamber, the housing having a borehole along the longitudinal axis of the housing as a result of which the housing has an inner side, the housing on the inner side including a projection;

an insulator partially situated in the borehole of the housing, the insulator having a longitudinal axis which extends from the combustion chamber-side end of the insulator to an end of the insulator which faces away from the combustion chamber, and the insulator including an insulator collar which is radially surrounded by the housing, an insulator base which is the combustion chamber-side end of the insulator and has a smaller diameter than the insulator collar, and a transition area which connects the insulator collar and the insulator base to one another and rests on the projection of the housing;

a center electrode situated in the insulator;

a ground electrode situated at the combustion chamber-side end of the housing, the ground electrode and the center electrode being situated in such a way that, together, the ground electrode and the center electrode form an ignition gap; and a breathing space which is configured at a combustion chamber-side end of the spark plug, the breathing space being delimited by a section of the housing and a section of the insulator base and having an opening to the combustion chamber, wherein the section of the insulator base which delimits the breathing space includes a rounding, the rounding, as viewed in cross-section, having a first leg length and a second leg length angled with respect to the first leg length, the first leg length being greater than the second leg length, the first leg length extending between an intersecting point of the first and second leg lengths with one another and a first end point of the rounding, and the second leg length extending between the intersecting point of the leg first and second lengths with one another and a second end point of the rounding.

2. The spark plug as recited in claim 1, wherein the first leg length is at least 1.5 times the second leg length.

3. The spark plug as recited in claim 1, wherein the first leg length is at least 2 times the second leg length.

4. The spark plug as recited in claim 1, wherein the first leg length is 5 times the second leg length.

5. The spark plug as recited in claim 1, wherein the first leg length is no more than 10 times the second leg length.

6. The spark plug as recited in claim 1, wherein the first leg length is no more than 7 times the second leg length.

7. The spark plug as recited in claim 1, wherein the first leg length extends in parallel to the longitudinal axis of the insulator, and the second leg length extends perpendicularly to the longitudinal axis of the insulator.

8. The spark plug as recited in claim 1, wherein the rounding is described by the first leg length L1 and the second leg length L2 and two angles $\alpha_1$ and $\alpha_2$, the angle $\alpha 1$ spanning between a tangent of the rounding in the second end point of the rounding and a first parallel, passing through the second end point of the rounding, to the longitudinal axis of the insulator, and the angle $\alpha_2$ spanning between a tangent of the rounding in the first end point of the rounding and a second parallel, passing through the first end point of the rounding, to the longitudinal axis of the insulator, the angle $\alpha 1$ having a value of greater than or equal to 0° and smaller than or equal to arctan (L2/L1) and/or the angle $\alpha_2$ having a value of greater than or equal to arctan (L2/L1) and smaller than or equal to 90°, and the second end point of the rounding being closer to the combustion chamber-side end of the spark plug than the first end point of the rounding.

9. The spark plug as recited in claim 1, wherein the rounding is a concave rounding at the insulator base.

10. The spark plug as recited in claim 1, wherein the rounding extends across an entire section of the insulator base which delimits the breathing space.

11. The spark plug as recited in claim 1, wherein a layer is at least partially applied to the section of the insulator base which delimits the breathing space, which is configured to trigger an ignition at the spark plug during irregular combustions in the combustion chamber.

12. A prechamber spark plug, comprising:

a housing, the housing having a longitudinal axis which extends from a combustion chamber-side end to an end of the housing which faces away from a combustion chamber, and the housing having a borehole along the longitudinal axis of the housing as a result of which the housing has an inner side, the housing on the inner side including a projection;

an insulator partially situated in the borehole of the housing, the insulator having a longitudinal axis which extends from the combustion chamber-side end to an end of the insulator which faces away from the combustion chamber, and the insulator including an insulator collar, which is radially surrounded by the housing, an insulator base, which is the combustion chamber-side end of the insulator and has a smaller diameter than the insulator collar, and a transition area, which connects the insulator collar and the insulator base to one another and rests on the projection of the housing;

a center electrode situated in the insulator;

a cap which is situated at the combustion chamber-side end of the housing and forms a prechamber;

a ground electrode situated at the housing or at the cap, the ground electrode and the center electrode being situated in such a way that, together, the ground electrode and the center electrode form an ignition gap; and a breathing space, which is configured at a combustion chamber-side end of the spark plug, the breathing space being delimited by a section of the housing and a section of the insulator base and having an opening to the combustion chamber enclosed by the cap, wherein the section of the insulator base delimiting the breathing space includes a rounding, the rounding, as viewed in cross-section, having a first leg length and a second leg length angled with respect to the first leg length, the first leg length being greater than the second leg length, the first leg length extending between an intersecting point of the first and second leg lengths with one another and a first end point of the rounding, and a second leg length extending between the intersecting point of the first and second leg lengths with one another and a second end point of the rounding.

* * * * *